United States Patent [19]

Stilling

[11] 4,287,555

[45] Sep. 1, 1981

[54] STRUT RACEWAYS FOR SIGN BOXES

[76] Inventor: Johann Stilling, Apt. #A1001, 1141 Royal York Rd., Islington, Ontario, Canada

[21] Appl. No.: 885,328

[22] Filed: Mar. 10, 1978

[51] Int. Cl.[3] ..... F21S 3/00

[52] U.S. Cl. ..... 362/225; 40/564; 362/223

[58] Field of Search ..... 362/217, 219, 223, 224, 362/225, 220, 221; 40/558, 564, 541, 572

[56] References Cited

U.S. PATENT DOCUMENTS

| | | | |
|---|---|---|---|
| 1,858,755 | 5/1932 | Van Wyck et al. | 40/564 |
| 2,298,824 | 10/1942 | Darley | 362/219 |
| 2,375,589 | 5/1945 | Rozier | 362/221 |
| 2,399,531 | 4/1946 | Young | 362/217 |
| 2,873,828 | 2/1959 | Zitomer | 362/217 |
| 3,065,343 | 11/1962 | Zurawski | 362/217 |

FOREIGN PATENT DOCUMENTS

| | | | |
|---|---|---|---|
| 603981 | 4/1960 | Italy | 362/219 |

*Primary Examiner*—Monroe H. Hayes

[57] ABSTRACT

An electrical raceway for installation in an illuminated double-sided sign box is in the form of an elongated and hollow structure which provides reinforcement for such a sign box and a housing for electrical conductors. Opening zones, usefully in the form of knock-out discs are provided in the side walls of the raceway for the mounting of lighting fixture receptacles while aligned openings in such side walls are provided for the disposition therethrough of an elongated lighting tube terminally fitted in receptacles on a pair of such raceways disposed on opposite sides thereof. Deformable tongues formed in such side walls at such openings can be bent toward the opposite side walls to provide barrier members to prevent the electrical conductors within such a raceway coming into contact with a lighting tube extending therethrough.

16 Claims, 5 Drawing Figures

STRUT RACEWAYS FOR SIGN BOXES

The invention relates to illuminated signs such as are used on store fronts and the like, and in particular to the construction of sign boxes for such signs wherein multiple horizontal fluorescent lighting tubes, are used, and wherein the sign is double-sided so that both sides must be illuminated by the same lighting tubes.

In the construction of double-sided illuminated signs, it is desirable that the construction and design of the sign box may be varied to accommodate the requirements of the customer. At the same time, it is desirable that the overall illumination of each side of the sign shall be as uniform as possible, and shall preferably be capable of being preset at a predetermined lighting level specified by the customer. These different criteria present certain problems. For example, lighting tubes come in certain standard lengths and, in the great majority of cases, the box for the sign will not correspond to the length of one tube or to a multiple of such tube lengths. Accordingly some provision must be made for overlapping lighting tubes within the box.

Similarly, the height of the box will vary, and some provision must be made for the use of a greater or lesser multiple of tubes, so as to provide a greater or lesser lighting intensity within the box for any given height of sign.

The problem of overlapping tubes inevitably means that some form of framework or raceway structure must be provided within the box to support the free ends of the tubes. However, it is desirable that such a framework shall as far as possible avoid obstructing the tubes, so as to avoid the development of dark vertical lines on one or other face of the sign. In addition, the location of such a vertical framework within the box, supporting opposite ends of overlapping tubes, has in the past resulted in the ends of the tubes being offset from one another. This may in some cases bring the lighting tubes somewhat closer to the surfaces they are intended to illuminate than is desirable. Either the illumination on the surfaces then becomes uneven i.e. there will be excessively bright horizontal lines, or the illuminated panels will become over-heated or, alternatively, the sign box must be made wider thereby producing an unsightly appearance and also increasing the weight and cost.

In addition to all of these factors, the construction and design of the sign box must have sufficient inherent rigidity that it can be mounted in for example a free standing position at the top of a post for example, and withstand wind and weather stresses. For this reason it is desirable to provide interior struts or framework, and again it is desirable as far as possible to ensure that such framework does not either obstruct the lighting, nor result in offsetting of the lighting tubes.

The invention seeks to overcome many of these disadvantages by the provision of a sign box incorporating a plurality of vertical raceways extending between the top and bottom of the sign, generally at intermediate locations between the two ends of the sign box, the raceways having openings extending completely through both sides thereof whereby lighting tubes may extend through the raceways, and having retaining means for retaining the wiring within the raceways out of contact with the tubes, and the raceways further being adapted to receive electrical receptacles for the mounting of the intermediate ends of the tubes.

The invention comprises an electrical raceway for incorporation in a double-sided sign box to provide structural reinforcement to such a sign box when incorporated therein so as to extend between spaced apart walls thereof, for the mounting of electrical receptacles for elongated lighting fixtures and for housing electrical conductors connected to such receptacles for the supply of electricity thereto which raceway is defined as comprising an elongated and hollow structure adapted to be disposed within such a sign box between such spaced apart walls thereof with such electrical conductors disposed therewithin and having mutually spaced apart side walls which are formed with electrical receptacle opening zones adapted to have electrical lighting fixture receptacles secured therein for the terminal engagement of elongated electrical lighting tubes and, spaced longitudinally apart from said opening zones along said side walls, aligned openings in said side walls for the free disposition therethrough of other such elongated electrical lighting tubes, and at least one retaining member adapted to project between said side walls of said raceway to retain electrical conductors in position within said raceway transversely outwardly of such lighting tubes.

An electrical raceway as provided by this invention is usefully formed in each of its side walls with a plurality of said opening zones adapted to have electrical lighting fixture receptacles secured therein and a plurality of said aligned openings for the disposition therethrough of elongated electrical lighting tubes.

The opening zones and the openings formed in the side walls of an electrical raceway in accordance with this invention are usefully formed so that, if two identical such raceways were disposed side-by-side in aligned and reversed longitudinal dispositions, an elongated electrical lighting tube terminally engaged in an electrical receptacle secured in any said opening zone in an opposed side wall of either of said raceways would extend freely through an aligned pair of said openings in the side walls of the other of said raceways.

The retaining members provided in an electrical raceway in accordance with this invention are usefully in the form of tongues which are integrally formed with the side walls of the raceway and which are deformable so as to extend between those side walls. Normally, such a raceway will comprise two generally diametrically opposed tongues integrally formed with each side wall of the raceway at each opening therethrough.

The electrical raceways of this invention have, as already indicated, an elongated and hollow structure and, in accordance with a preferred feature of this invention, they have a two-part structure, one part comprising a channel having a base web constituting one of the side walls of the raceway and mutually spaced apart front and rear walls projecting therefrom, and the other part comprising the other of the side walls of the raceway and edge flanges adapted releasably to engage the front and rear walls of the channel.

With such a two-part construction, each of the front and rear walls of the channel is usefully formed with at least one, and preferably two, longitudinally extending reinforcing ribs. A co-operating longitudinally extending rib on the edge flange of the cover can then be provided to permit releasable snap engagement of such cover with the channel.

While the opening zones provided in the side walls of an electrical raceway in accordance with this invention can have any desired configuration, it is preferred at this time that each such opening zone be in the form of a major segment of a circle, each such segment being defined in part by a chord.

When used herein and in the appended claims, the expression "opening zones" is intended to embrace not only actual openings in the side walls of a raceway as provided by this invention but also knock-out or releasably retained portions of such side walls and which portions can be removed, as desired, to provide such actual openings for the installation of electrical lighting fixture receptacles.

The raceways provided by this invention will normally be provided with means by which they can be secured in position within a sign box and such securement means will usefully permit the raceways to act as bracing struts to improve the structural stability of the sign box.

The present invention additionally comprises a sign box comprising front and rear panels and having at least two electrical raceways as previously defined disposed therewithin between opposed walls of such a sign box and in mutually spaced apart and generally mutually parallel disposition.

In general, such a sign box will normally be provided with at least four electrical raceways, two end ones of such raceways being disposed within the sign box generally at opposite ends thereof and two intermediate ones of such raceways being as previously defined and being disposed within the sign box in mutually spaced apart positions between such ends thereof. Lighting fixture receptacles are then fitted in the opening zones of the raceways so that elongated lighting tubes such as fluorescent tubes, can be installed in such receptacles so that each such tube extends from one of said end raceways to one of said intermediate raceways and through a pair of the aligned openings in the side walls of the other of the intermediate ones of such raceways.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 1:
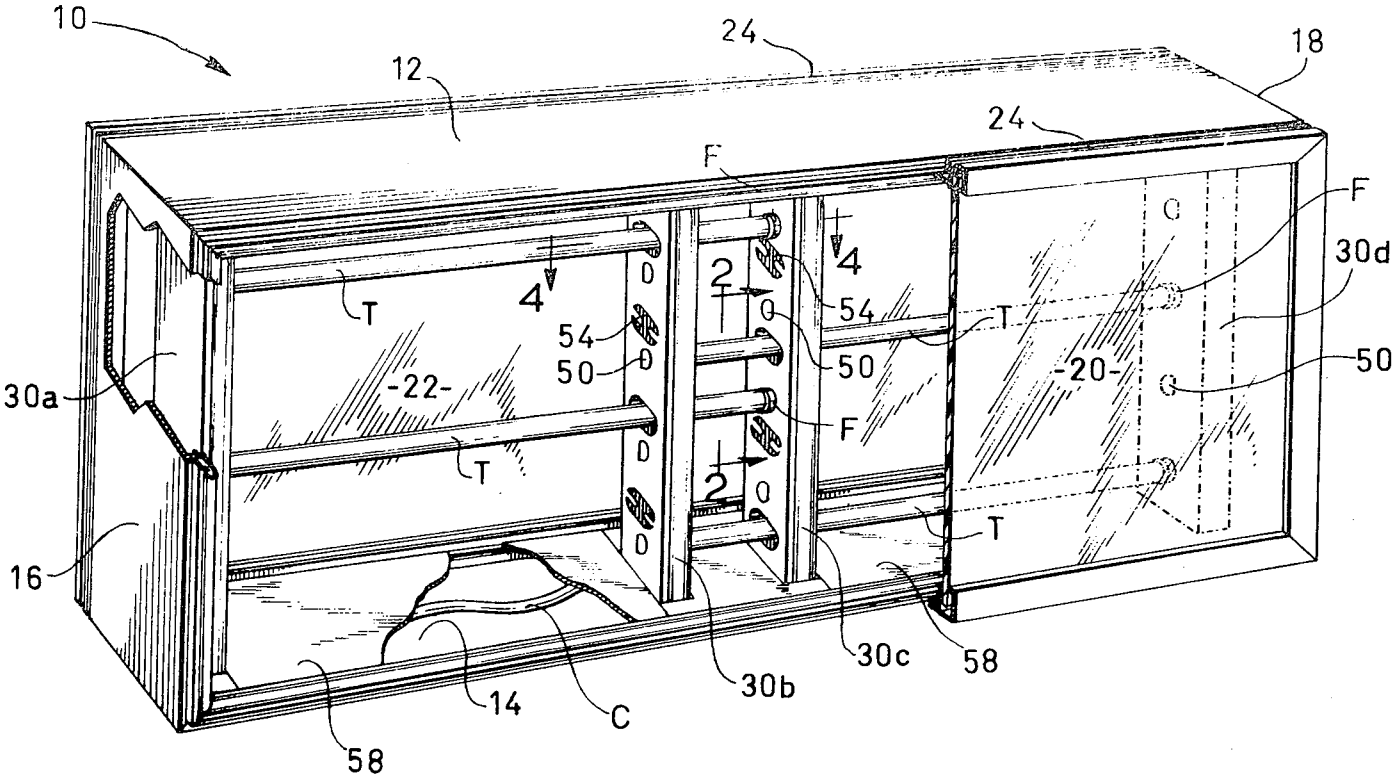
FIG. 1 is a cut-away perspective illustration showing one embodiment of a sign according to the present invention.

In FIG. 1, a sign box shown generally at 10 has a top wall 12, a bottom wall 14, a left-hand end wall 16 and a right-hand end wall 18.

Two translucent message bearing front and rear panels 20 and 22 respectively are provided on each face of the sign, and are usually manufactured of plastic or the like, and are typically mounted in frames 24. The frames 24 are usually hingedly attached along the free edges of the top wall 12 of the sign 10.

All of these features are well known in the art and are disclosed in, for example, U.S. Pat. No. 3,863,372.

Within the interior of the sign box 10, in this preferred embodiment of the invention, there are provided multiple lighting tubes T, in this case only four such tubes T are shown. They may be of course any one of a variety of standard lighting tubes which may be manufactured in different but standarized lengths.

Such tubes T are mounted in standardized lighting fixtures or receptacles F all of which are well known in the lighting art.

Within the sign box 10, a plurality, in this case four, vertically arranged electrical raceways **30*a*, 30*b*, 30*c*, and 30*d* are provided so as to be spaced apart along the length of the sign box 10. While four such raceways are shown, it will be appreciated that, in the case of a shorter sign box 10**, it may be necessary to have raceways only at the ends, when for example the sign corresponds to the standardized length of a lighting tube T.

However in the majority of cases where the sign is longer than the standardized length of such lighting tubes, then a minimum of four such raceways 30 must be provided. In the case of very long signs then it may be necessary to provide six or even eight or more such raceways 30.

The raceways **30*a* and 30*d* at the ends 16 and 18 of the box 10 are designated as end raceways, and the raceways 30*b* and 30*c* towards the centre of the sign box 10** are designated as intermediate raceways.

The end raceway **30*d* at the right hand end of the sign box 10 is hidden from view, in FIG. 1, by the front panel 20** and is simply shown in phantom outline for the sake of completeness.

Figure 2:
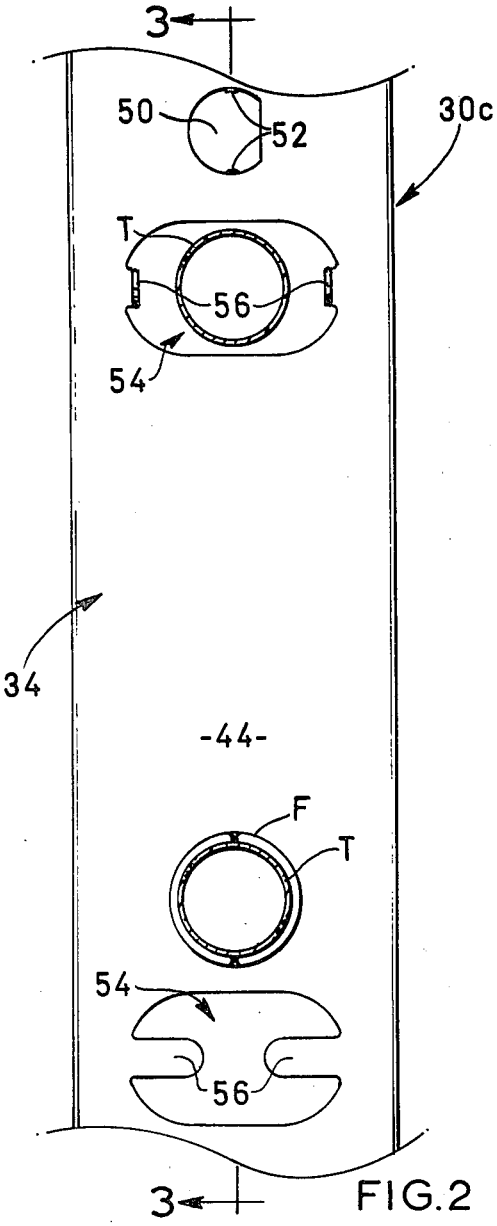
FIG. 2 is a fragmentary side elevation of one raceway incorporated in the sign shown in FIG. 1 when viewed as indicated by the arrows 2—2.
Figure 3:
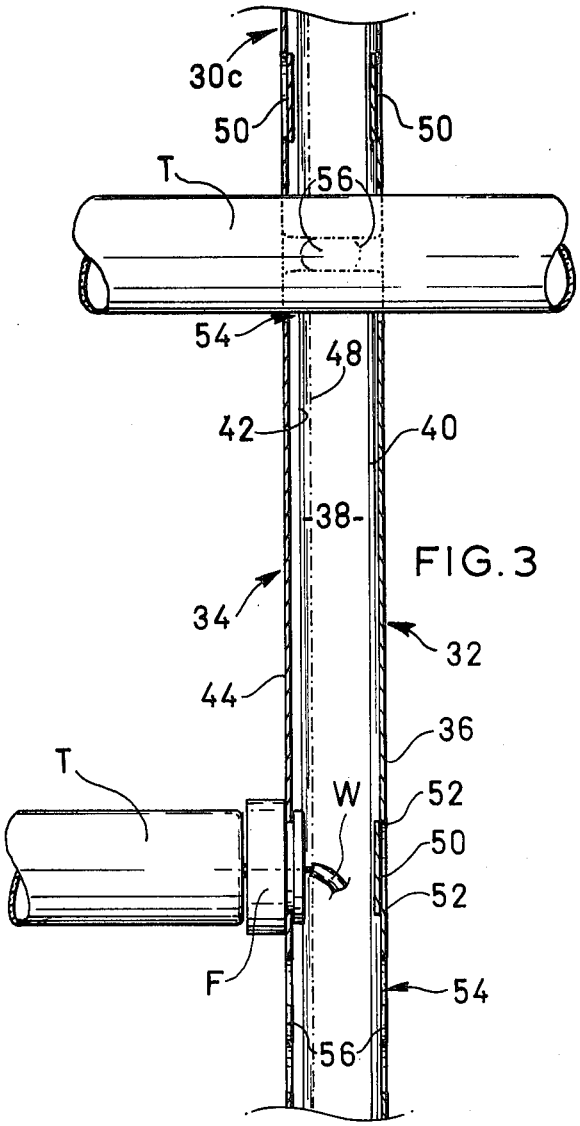
FIG. 3 is a vertical sectional view taken along the line 3—3 of FIG. 2.
Figure 4:
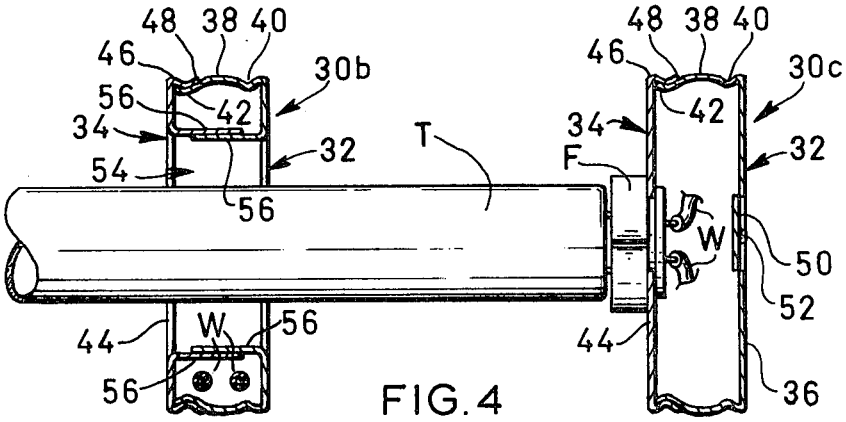
FIG. 4 is a sectional view taken along the line 4—4 of FIG. 1.

Referring now to FIGS. 2, 3 and 4 each of the intermediate raceways **30*b* and 30*c* will be seen to be of a two-part construction and to comprise a channel portion 32 and a cover 34**.

The channel portion 32 of each of the raceways **30*b* and 30*c* has a side wall 36 and front and rear walls 38. The front and rear walls 38 are formed with longitudinally extending ribs 40, adjacent the junction with the side wall 36, and longitudinally extending ribs 42 adjacent the free edges of the front and rear walls 38**.

The cover 34 consists of a generally flat planar wall 44 constituting one of the side walls of the raceway, and edge flanges 46 formed with longitudinally extending reinforcing ribs 48 therein. The ribs 48 are shaped to interfit with the ribs 42 on the walls 38 of the channel 32 thereby providing a snap closure for the open side of the channel 32.

The side wall 36 of the channel portion 32 is provided with a plurality of spaced apart knockout discs 50, being essentially depressions formed in the wall 36, which remain attached to the main portion of the wall 36 by means of the tabs 52. Such knockout discs 50 are well known in the electrical fixture art and require no further explanation.

The wall 36 of the channel portion 32 is also provided with a plurality of elongated generally oval shaped openings 54, which are partially traversed by bendable tongue or retaining members 56.

The cover 34 in its wall 44 is similarly provided with knockout discs 50 and openings 54 and tongues 56, the openings 54 registering with the corresponding openings in the wall 36 of the channel portion 32. While the knockout discs 50 in the walls 36 and 44 are usefully aligned, such alignment is not essential.

Referring now to FIGS. 1 and 4, the raceways are employed in the box 10, by locating the end raceways 30*a* and 30*d* at either end of the box, at more or less equal distances between the two translucent panels 20. While the end raceways 30*a* and 30*d* can have structures identical to those of the intermediate raceways 30*b* and 30*c*, this is not essential and, for this reason, those end raceways are shown in FIG. 1 as being provided with only knockout discs 50 for the mounting of fixture receptacles F.

At spaced intervals, suitable electrical receptacle fittings F are installed in the openings left by the removal of knockout discs 50. It will be appreciated that as shown in FIG. 1 the fittings F in the right hand raceway 30*d* will be offset either downwardly or upwardly with respect to the fittings F (not shown) in the left hand raceway 30*a*, so that when tubes T are inserted into these fittings, they will be able to extend in overlapping relation without contacting one another.

The intermediate raceway 30*c* is then installed with electrical receptacle fittings F facing the left hand raceway 30*a*, and registering with the fittings F in raceway 30*a*, so that tubes T may be inserted in the fittings F at the respective ends of the tubes.

Similarly, the electrical raceway 30*b* is installed with fittings F facing the right hand raceway 30*d*, and registering with the fittings in that raceway.

Where it is necessary for the tubes T to pass through raceways 30*b* and 30*c* as shown, tongues 56 will be bent as shown in FIG. 4 so as to permit the tubes T to pass through the openings 54.

The bending of the tongues 56 is arranged so as to entrap any electrical wiring W at the sides of the channel portion 32, and hold that wiring out of contact with the tube T as shown in FIG. 4. In FIG. 1, the sign box 10 is shown as being provided with floor panels 58 beneath which the main electrical supply cable C is housed.

Clearly, it is possible to construct a sign box of greater length simply by using another pair of intermediate raceways.

By the practice of the invention, it will be noted that the tubes T are all arranged in a common vertical plane so that the translucent panels 20 can be arranged as close as possible to the tubes T without producing overheating or uneven illumination. In addition, the raceways 30*b* and 30*c* are arranged so as to cause the minimum interference with the light from the tubes T.

The intermediate raceways 30*b* and 30*c* also add to the overall strength and rigidity of the sign 10, and therefore effectively perform a dual function.

Figure 5:
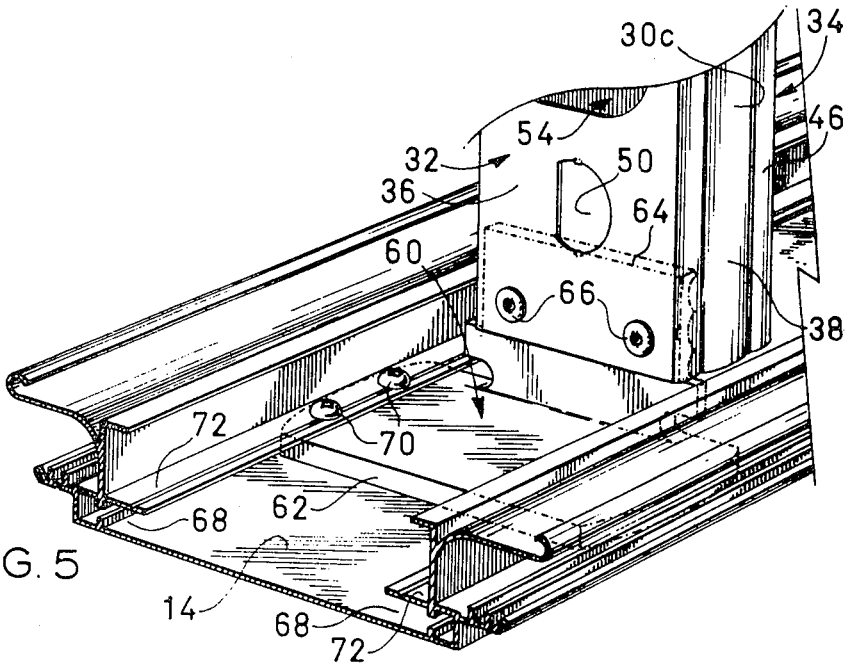
FIG. 5 is a fragmentary perspective view showing one way in which a raceway can be secured in a sign in accordance with this invention.

Reference will finally be made to FIG. 5 of the accompanying drawings in which there is illustrated one way in which a raceway may be secured in position in the sign box 10. In that figure, the vertical raceway 30*c* is shown as being secured in position by means of an L-shaped bracket generally indicated at 60 and comprising a horizontal leg 62 and integrally formed therewith an upstanding vertical leg shown in phantom outline at 64. The upstanding vertical leg 64 of the bracket 60 is disposed within the raceway 30*c* and is secured by rivets 66 to the side wall 36 of the channel portion 32 of the raceway.

The horizontal leg 62 of the bracket 60 has its front and rear edges received within channels 68 of the bottom wall 14 of the sign box 10 and is held in position by screws 70 extending through flanges 72 defining such channels.

While the invention has hereinbefore been specifically described with reference to the particular embodiment thereof as shown in the accompanying drawings, it should be understood that numerous variations in and modifications of the described structure are possible without departing from the scope of the invention. Merely by way of illustration, it may be indicated that the invention is in no way restricted to the use of the means shown in FIG. 5 of the drawings for securing a raceway in position in a sign box. Other variations within the scope of the invention will be readily apparent to those conversant with the relevant technologies.

What is claimed is:

1. An electrical raceway for incorporation in a double-sided sign box to provide structural reinforcement to such a sign box when incorporated therein so as to extend between spaced apart walls thereof, for the mounting of electrical receptacles for elongated lighting tubes and for housing electrical conductors connected to such receptacles for the supply of electricity thereto and which raceway comprises;

an elongated and hollow structure adapted to be disposed within such a sign box between such spaced apart walls thereof with such electrical conductors disposed therewithin and having mutually spaced apart side walls;

electrical receptacle opening zones formed in said side walls adapted to have electrical lighting fixture receptacles secured therein for the terminal engagement of elongated electrical lighting tubes;

lighting tube openings in said side walls, spaced longitudinally apart from said opening zones along said side walls, said openings being formed in aligned pairs for the free disposition therethrough of other such elongated electrical lighting tubes whereby such a tube may pass completely through such raceway without contacting the same, and, at least one retaining member adapted to project between said side walls of said raceway adjacent such pairs of openings to retain electrical conductors in position within said raceway transversely outwardly of such lighting tubes extending through said aligned openings.

2. An electrical raceway as claimed in claim 1 and in which said opening zones in said side walls are mutually aligned.

3. An electrical raceway as claimed in claim 1 and in which each said side wall thereof is formed with a plurality of said opening zones adapted to have electrical lighting fixture receptacles secured therein and a plurality of said openings for the disposition therethrough of elongated electrical lighting tubes.

4. An electrical raceway as claimed in claim 3 and in which said opening zones and said openings are formed in said side walls so that, if two identical said raceways were disposed side-by-side in aligned and reversed longitudinal dispositions, an elongated electrical lighting tube terminally engaged in an electrical receptacle secured in any said opening zone in an opposed side wall of either of said raceways would extend freely through an aligned pair of said openings in the side walls of the other of said raceways.

5. An electrical raceway as claimed in claim 4 and in which said retaining member extends between said side walls of said raceway partially to define a pair of said aligned openings in said side walls.

6. An electrical raceway as claimed in claim 5 and in which said retaining member comprises a tongue integrally formed with one of said side walls and deformable so as to extend between said side walls.

7. An electrical raceway as claimed in claim 6 and which comprises two generally diametrically opposed said tongues integrally formed with each said side wall at each said opening therethrough.

8. An electrical raceway as claimed in claim 7 and which comprises a channel having a base web constituting one of said side walls of said raceway and mutually spaced apart front and rear walls projecting therefrom and a cover releasably secured on said channel and comprising the other of said side walls of said raceway and edge flanges adapted releasably to engage said front and rear walls of said channel.

9. An electrical raceway as claimed in claim 8 and in which said channel is formed in each of said front and rear walls thereof with at least one longitudinally extending reinforcing rib.

10. An electrical raceway as claimed in claim 9 and in which each said edge flange of said cover is formed with a longitudinally extending rib adapted releasably to engage a said reinforcing rib on a respective one of said front and rear walls of said channel so as to retain said cover releasably in position on said channel.

11. An electrical raceway as claimed in claim 10 and in which each of said front and rear walls of said channel is formed with two said longitudinally extending reinforcing ribs which are mutually spaced apart.

12. An electrical raceway as claimed in claim 11 and in which each said opening zone is a major segment of a circle, each such segment being defined in part by a chord.

13. An electrical raceway as claimed in claim 11 and in which each said opening zone is in the form of an actual opening in a respective one of said side walls of said channel.

14. An electrical raceway as claimed in claim 11 and in which each said opening zone contains a portion of a respective one of said side walls and which portion is detachably retained in position.

15. A sign box comprising front and rear panels mounted on box walls extending between said front and rear panels and having at least two electrical raceways as claimed in claim 1 disposed therewithin and extending between opposed said box walls in mutually spaced apart and generally mutually parallel disposition.

16. A sign box as claimed in claim 15 and in which electrical lighting fixture receptacles are mounted in said opening zones in said side walls of said electrical raceways so that lighting tubes terminally engaged in such receptacles extend through pairs of aligned said openings in said side walls of others of said raceways.

* * * * *